US011455939B2

(12) United States Patent
Watanabe

(10) Patent No.: US 11,455,939 B2
(45) Date of Patent: Sep. 27, 2022

(54) INTERFACE CIRCUIT, SOURCE DRIVER, AND DISPLAY DEVICE

(71) Applicant: LAPIS Technology Co., Ltd., Yokohama (JP)

(72) Inventor: Yukinobu Watanabe, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 0 days.

(21) Appl. No.: 17/529,452

(22) Filed: Nov. 18, 2021

(65) Prior Publication Data

US 2022/0172668 A1 Jun. 2, 2022

(30) Foreign Application Priority Data

Nov. 27, 2020 (JP) ..... JP2020-196820

(51) Int. Cl.
*G09G 3/20* (2006.01)
*G09G 3/36* (2006.01)

(52) U.S. Cl.
CPC ..... *G09G 3/2096* (2013.01); *G09G 3/3688* (2013.01); *G09G 3/3696* (2013.01); *G09G 2310/08* (2013.01)

(58) Field of Classification Search
CPC ..... G09G 2300/0861; G09G 3/3241; G09G 2300/0452; G09G 2300/0842
See application file for complete search history.

(56) References Cited

U.S. PATENT DOCUMENTS

2003/0156102 A1* 8/2003 Kimura ..... G09G 3/325 345/204
2003/0169250 A1* 9/2003 Kimura ..... G09G 3/3283 345/212
2007/0126678 A1* 6/2007 Shih ..... G09G 3/342 345/89
2007/0216612 A1* 9/2007 Shin ..... G11C 19/184 345/76
2016/0055791 A1* 2/2016 Kishi ..... G09G 3/3241 345/212

FOREIGN PATENT DOCUMENTS

JP 2018-054830 A 4/2018

* cited by examiner

*Primary Examiner* — Van N Chow
(74) *Attorney, Agent, or Firm* — Rabin & Berdo, P.C.

(57) ABSTRACT

An interface circuit generates a timing signal indicating the timing at which to switch between a data input period and a non-input period, and outputs a second start pulse signal obtained by delaying a first start pulse signal. Anomaly detection circuits detect an anomaly that has occurred in source drivers, and a detection result selection circuit selects one of the anomaly detection circuits during the non-input period and outputs a detection result signal indicating detection results. A selector selectively outputs the second start pulse signal or the detection result signal on the basis of the timing signal.

5 Claims, 9 Drawing Sheets

INTERFACE CIRCUIT, SOURCE DRIVER, AND DISPLAY DEVICE

CROSS REFERENCE TO RELATED APPLICATION

This application is based upon and claims the benefit of priority of the prior Japanese Patent Application No. 2020-196820, filed on Nov. 27, 2020, the entire contents of which are incorporated herein by reference.

Technical Field

The present invention relates to an interface circuit, a source driver, and a display device.

Background Art

In liquid crystal display devices, an image signal is transmitted from a display control device such as a timing controller to a source driver that drives a liquid crystal panel. An example of a transmission mode for the image signal is mini-LVDS (mini-low voltage differential signaling). Mini-LVDS is one type of differential signal mode for transmitting an image signal as a differential signal, and enables transmission of up to an 8-bit image signal on one pair (one set of two) of signal wiring lines.

Liquid crystal display devices are provided with an anomaly detection circuit for detecting anomalies that occur in the source driver or the like. In some cases, a plurality of anomaly detection circuits are provided in the source driver in order to detect various anomalies such as temperature anomalies, voltage value anomalies, and polarity inversion anomalies. In order to output detection results by the plurality of anomaly detection circuits, the respective anomaly detection circuits are selected at different timings, and the detection results from the selected circuit are outputted by time division. In this case, the interface circuit in the source driver receives selection signals from the display control device such as the timing controller, and selects the anomaly detection circuit in response thereto. As such an interface circuit, an interface circuit that enables transmission, from a source driver to a TCON (timing controller), of the detection results of anomalous states by each anomaly detection circuit through mini-LVDS is proposed (e.g., in Japanese Patent Application Laid-Open Publication No. 2018-54830).

This interface circuit is provided with an input data control circuit that acquires a clock signal supplied from the TCON and a plurality of input data signals, and a control mode signal input detection circuit that receives an LS signal that serves as a delineation for display data and generates a control signal input mode signal that measures the timing for starting data input, for example. Also, the interface circuit is provided with a signal line for transmitting a start pulse signal inputted and outputted between source drivers where a plurality of source drivers are in a cascade connection. The interface circuit is additionally provided with a plurality of anomaly detection circuits, and an anomaly detection selection circuit that uses a NAND output of a differential input signal of a mini-LVDS interface as a selection signal to selectively output detection results of the plurality of anomaly detection circuits. The output of the anomaly detection selection circuit has an open drain terminal configuration as an FD_OUT signal, and is pulled up by a power source outside of the chip.

In control signal input mode, an H level control mode signal is supplied, and the detection results of the plurality of anomaly detection circuits are sequentially outputted as the FD_OUT signals. Also, by performing control such that when all input data signals from the TCON are at an H level, an L level FD_OUT signal is outputted, it is possible to detect whether a disconnection (that is, an open circuit failure) has occurred in an FD_OUT terminal

SUMMARY OF THE INVENTION

However, the interface circuit configured as described above had the problem that it was not possible to detect open circuit failure in the case of a configuration in which a plurality of source drivers are in a cascade connection. If, for example, a first driver and a second driver, among first to third drivers in a cascade connection with each other, are in normal operation, and only the third driver has had a disconnection (open circuit), for example, then if all input data signals for detecting an open circuit failure in the FD_OUT terminals are at an H level, then because the first driver and the second driver output L level signals, the TCON detects L level signals and determines that no disconnection has occurred. Thus, there was the problem that even if one of the plurality of source drivers had an open circuit failure, the TCON could not detect the open circuit failure.

In order to solve this problem, an object of the present invention is to provide an interface circuit that can detect an open circuit failure in signal output terminals of source drivers even in a configuration in which a plurality of source drivers are in a cascade connection.

An interface circuit according to the present invention is an interface circuit that is provided to one source driver that is configured to drive a display device, the interface circuit being configured to receive input of a plurality of data signals, each of which is constituted of a sequence of pixel data pieces, and supply the plurality of data signals to a data latch circuit provided to the one source driver, the interface circuit including: a timing signal generating circuit that is configured to receive input of a clock signal and, on the basis of at least one of the plurality of data signals and the clock signal, generate a timing signal indicating a timing for switching between a data input period during which the plurality of data signals are supplied to the data latch circuit, and a non-input period during which supply of the plurality of data signals is stopped; a data control circuit that is configured to receive input of a first start pulse signal indicating a start of data input of the plurality of data signals to the data latch circuit, control supply of the plurality of data signals to the data latch circuit on the basis of the timing signal and the first start pulse signal, and output, to another source driver connected to the one source driver, a second start pulse signal that is a signal formed by delaying the first start pulse signal; a plurality of anomaly detection circuits that are configured to detect an anomaly that has occurred in the one source driver; a detection result selection circuit that is configured to select one of the plurality of anomaly detection circuits on the basis of the plurality of data signals, and output a detection result signal indicating a detection result of the selected anomaly detection circuit at a timing based on the timing signal and the clock signal, during the non-input period; a selector that is configured to receive input of the second start pulse signal and the detection result signal, and, on the basis of the timing signal, selectively output either one of the second start pulse signal and an output of the detection result selection circuit; and a signal output unit that includes a first conductivity type MOS transistor having a gate terminal that is connected to an output unit of the selector and a source terminal that is connected to a prescribed potential, and a signal output line that is connected to a drain terminal of the MOS transistor.

A source driver according to the present invention is a source driver that is configured to drive a display device on the basis of a plurality of data signals, each of which is constituted of a sequence of pixel data pieces, the source driver including: an interface circuit that is configured to receive a clock signal and the plurality of data signals, and output the plurality of data signals according to a clock timing of the clock signal; a latch circuit that is configured to acquire the plurality of data signals outputted from the interface circuit and output the data signals as each of the plurality of pixel data pieces corresponding to a pixel column in a scanning line direction of the display device; a gradation voltage generating unit that is configured to generate a plurality of gradation voltages on the basis of the plurality of pixel data pieces outputted from the latch circuit; and an output unit that is configured to select one gradation voltage corresponding to a luminance level indicated by the pixel data pieces from among the plurality of gradation voltages, and output a signal having the one gradation voltage as a driving signal of the display device, and wherein the interface circuit includes: a timing signal generating circuit that is configured to receive input of the clock signal and, on the basis of at least one of the plurality of data signals and the clock signal, generate a timing signal indicating a timing for switching between a data input period during which the plurality of data signals are supplied to the latch circuit, and a non-input period during which supply of the plurality of data signals is stopped; a data control circuit that is configured to receive input of a first start pulse signal indicating a start of data input of the plurality of data signals to the latch circuit, control supply of the plurality of data signals to the latch circuit on the basis of the timing signal and the first start pulse signal, and output, to another source driver connected to the source driver, a second start pulse signal that is a signal formed by delaying the first start pulse signal; a plurality of anomaly detection circuits that are configured to detect an anomaly that has occurred in the source driver; a detection result selection circuit that is configured to select one of the plurality of anomaly detection circuits on the basis of the plurality of data signals, and output a detection result signal indicating a detection result of the selected anomaly detection circuit at a timing based on the timing signal and the clock signal, during the non-input period; a selector that is configured to receive input of the second start pulse signal and the detection result signal, and, on the basis of the timing signal, selectively output either one of the second start pulse signal and an output of the detection result selection circuit; and a signal output unit that includes a first conductivity type MOS transistor having a gate terminal that is connected to an output unit of the selector and a source terminal that is connected to a prescribed potential, and a signal output line that is connected to a drain terminal of the MOS transistor.

A display device according to the present invention is a display device including: a display panel having a plurality of data lines and a plurality of scanning lines, and pixel switches and pixel units provided at respective intersections between the plurality of data lines and the plurality of scanning lines; a display control unit that is configured to output a clock signal, a plurality of data signals, each of which is constituted of a sequence of pixel data pieces, and a start pulse signal indicating a start for acquiring the pixel data pieces; and a plurality of source drivers that are disposed along an extension direction of the scanning lines, and each of which is configured to drive the display device on the basis of the plurality of data signals, wherein each of the plurality of source drivers includes: an interface circuit that is configured to receive a clock signal and the plurality of data signals, and output the plurality of data signals according to a clock timing of the clock signal; a latch circuit that is configured to acquire the plurality of data signals outputted from the interface circuit and output the data signals as each of the plurality of pixel data pieces corresponding to a pixel column in a scanning line direction of the display device; a gradation voltage generating unit that is configured to generate a plurality of gradation voltages on the basis of the plurality of pixel data pieces outputted from the latch circuit; and an output unit that is configured to select one gradation voltage corresponding to a luminance level indicated by the pixel data pieces from among the plurality of gradation voltages, and output a signal having the one gradation voltage as a driving signal of the display device, and wherein the interface circuit includes: a timing signal generating circuit that is configured to receive input of the clock signal and, on the basis of at least one of the plurality of data signals and the clock signal, generate a timing signal indicating a timing for switching between a data input period during which the plurality of data signals are supplied to the latch circuit, and a non-input period during which supply of the plurality of data signals is stopped; a data control circuit that is configured to receive input of a first start pulse signal indicating a start of data input of the plurality of data signals to the latch circuit, control supply of the plurality of data signals to the latch circuit on the basis of the timing signal and the first start pulse signal, and output, to another source driver connected to the source driver, a signal formed by delaying the start pulse signal; a plurality of anomaly detection circuits that are configured to detect an anomaly that has occurred in the source driver; a detection result selection circuit that is configured to select one of the plurality of anomaly detection circuits on the basis of the plurality of data signals, and output a detection result signal indicating a detection result of the selected anomaly detection circuit at a timing based on the timing signal and the clock signal, during the non-input period; a selector that is configured to receive input of the start pulse signal and the detection result signal, and, on the basis of the timing signal, selectively output either one of the start pulse signal and output of the detection result selection circuit; and a signal output unit that includes a first conductivity type MOS transistor having a gate terminal that is connected to an output unit of the selector and a source terminal that is connected to a prescribed potential, and a signal output line that is connected to a drain terminal of the MOS transistor.

According to the interface circuit of the present invention, it is possible to detect whether an open circuit failure has occurred in the signal output terminals even if a plurality of source drivers are in a cascade connection.

DETAILED DESCRIPTION OF EMBODIMENTS

Figure 1:
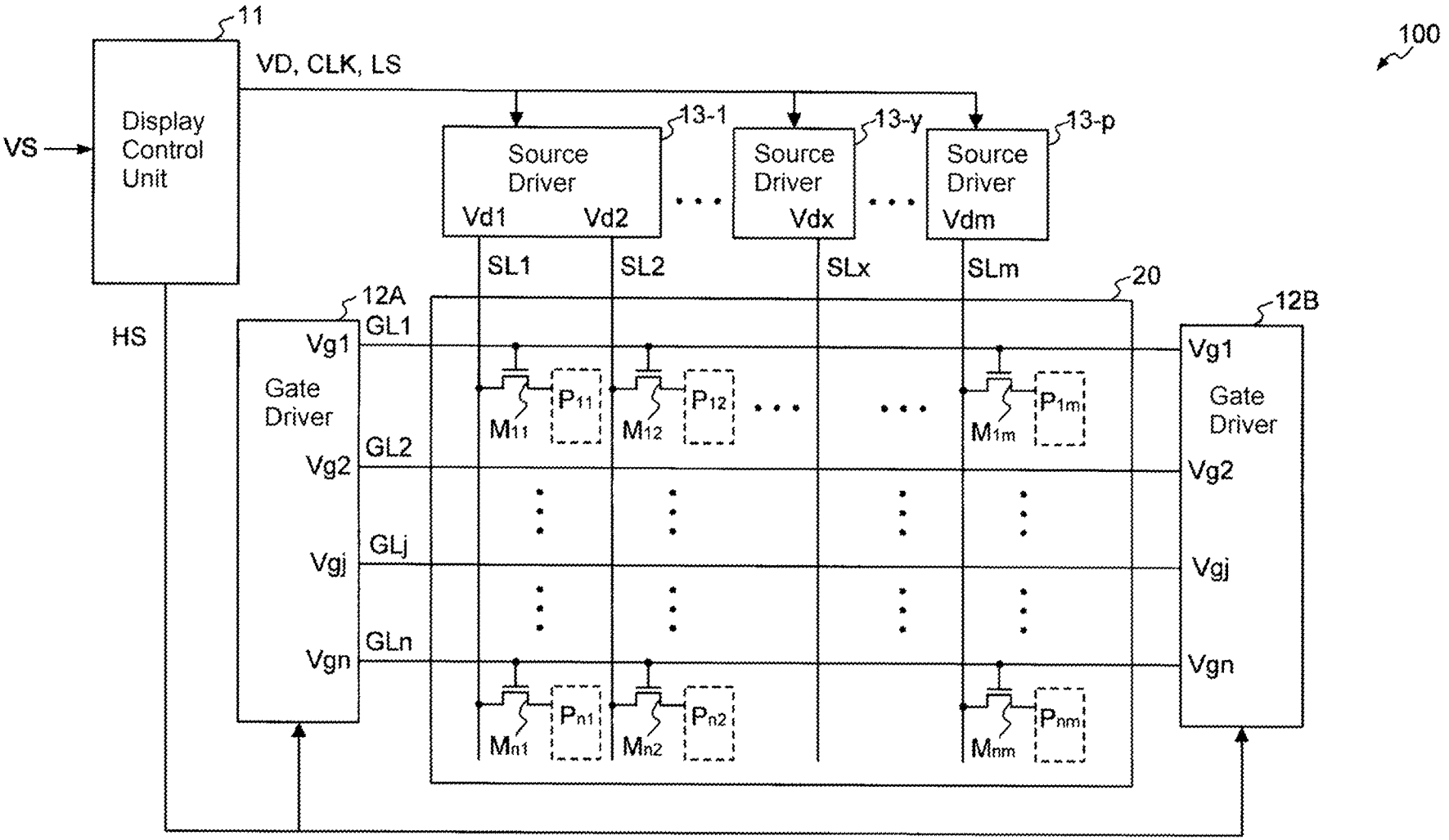
FIG. 1 is a block diagram showing a configuration of a display device 100 of the present invention.

Embodiments of the present invention will be explained below with reference to the drawings. In the description of the embodiment and the affixed drawings below, parts that are substantially the same or equivalent to each other are assigned the same reference characters.

FIG. 1 is a block diagram showing a configuration of a display device 100 that includes an interface circuit of the present invention. The display device 100 is an active matrix driven liquid crystal display device. The display device 100 has a display control unit 11, gate drivers 12A and 12B, source drivers 13-1 to 13-*p*, and a display device 20.

The display control unit 11 is a display control device that is constituted of a timing controller (TCON) or the like and supplies an image data signal VD, a clock signal CLK, and a line start signal LS to the source drivers 13-1 to 13-*p*, thereby controlling the display timing for images in a liquid crystal display panel, for example. The display control unit 11 transmits the image data signal VD by a differential signal mode such as mini-LVDS (mini-low voltage differential signaling), for example.

The display control unit 11 generates a sequence of pixel data pieces PD that represents the luminance level of each pixel with 6-bit luminance gradations on the basis of an input image signal VS, for example, and supplies the image data signal VD including the sequence of pixel data pieces PD to the source drivers 13. In the explanation below, an example will be described in which the image data signal VD includes input data signals LV0, LV1, and LV2. The input data signals LV0, LV1, and LV2 are signals that change levels between a logic level of 1 and a logic level of 0 according to the clock period of the clock signal CLK, and are differential signals transmitted by mini-LVDS. In the explanation below, the logic level of 1 is referred to as an H level (high level) and the logic level of 0 is referred to as an L level (low level).

Also, the display control unit 11 supplies, to the source drivers 13-1 to 13-*p*, the clock signal CLK and the line start signal LS indicating the position (e.g., the initial position) for delineating n pixel data pieces PD corresponding to respective horizontal scanning lines. Additionally, the display control unit 11 detects a horizontal synchronizing signal HS from the input image signal VS and supplies the horizontal synchronizing signal HS to the gate drivers 12A and 12B.

The display device 20 is an image display device constituted of a liquid crystal display panel, an organic EL (electroluminescent) panel, or the like, for example. The display device 20 has formed therein n (n being a natural number of 2 or greater) horizontal scanning lines GL1 to GLn that extend in the horizontal direction of a 2-dimensional screen, and m (m being a natural number of 2 or greater) source lines SL1 to SLm that extend in the vertical direction of the 2-dimensional screen. The intersecting regions between the horizontal scanning lines and the source lines are provided with pixel units $P_{11}$ to $P_{nm}$ and pixel switches $M_{11}$ to $M_{nm}$, and have formed therein display cells that function as pixels.

The gate drivers 12A and 12B supply gate signals Vg1 to Vgn to the gate lines GL1 to GLn on the basis of the synchronization timing of the horizontal synchronizing signal HS supplied from the display control unit 11. The pixel units $P_{11}$ to $P_{nm}$ of each pixel row are selected according to the supply of the gate signals Vg1 to Vgn. By gradation voltage signals Vd1 to Vdm being supplied from the source drivers 13-1 to 13-*p* to the selected pixel units, the gradation voltage signals Vd1 to Vdm are written to the pixel electrodes.

The source drivers 13-1 to 13-*p* are each provided for a prescribed number of source lines that are grouped by dividing the source lines SL1 to SLm. The number of source lines driven by each source driver corresponds to the output channel count of the source driver. For example, if each source driver has an output channel count of 960, then if the display panel has one source line per pixel column, the source lines are driven by 12 source drivers in the case of a 4K panel and 24 source drivers in the case of an 8K panel. Each of the source drivers 13-1 to 13-*p* is formed in a semiconductor IC (integrated circuit) chip.

The source drivers 13-1 to 13-*p* generate the gradation voltage signals Vd1 to Vdm on the basis of the image data signal VD, the line start signal LS, and the clock signal CLK, and supply the gradation voltage signals to the source lines SL1 to SLn. Also, the source drivers 13-1 to 13-*p* have the function of detecting anomalies therein, generating an anomaly detection signal ERR indicating the detection results, and supplying the anomaly detection signal to the display control unit 11.

Figure 2:
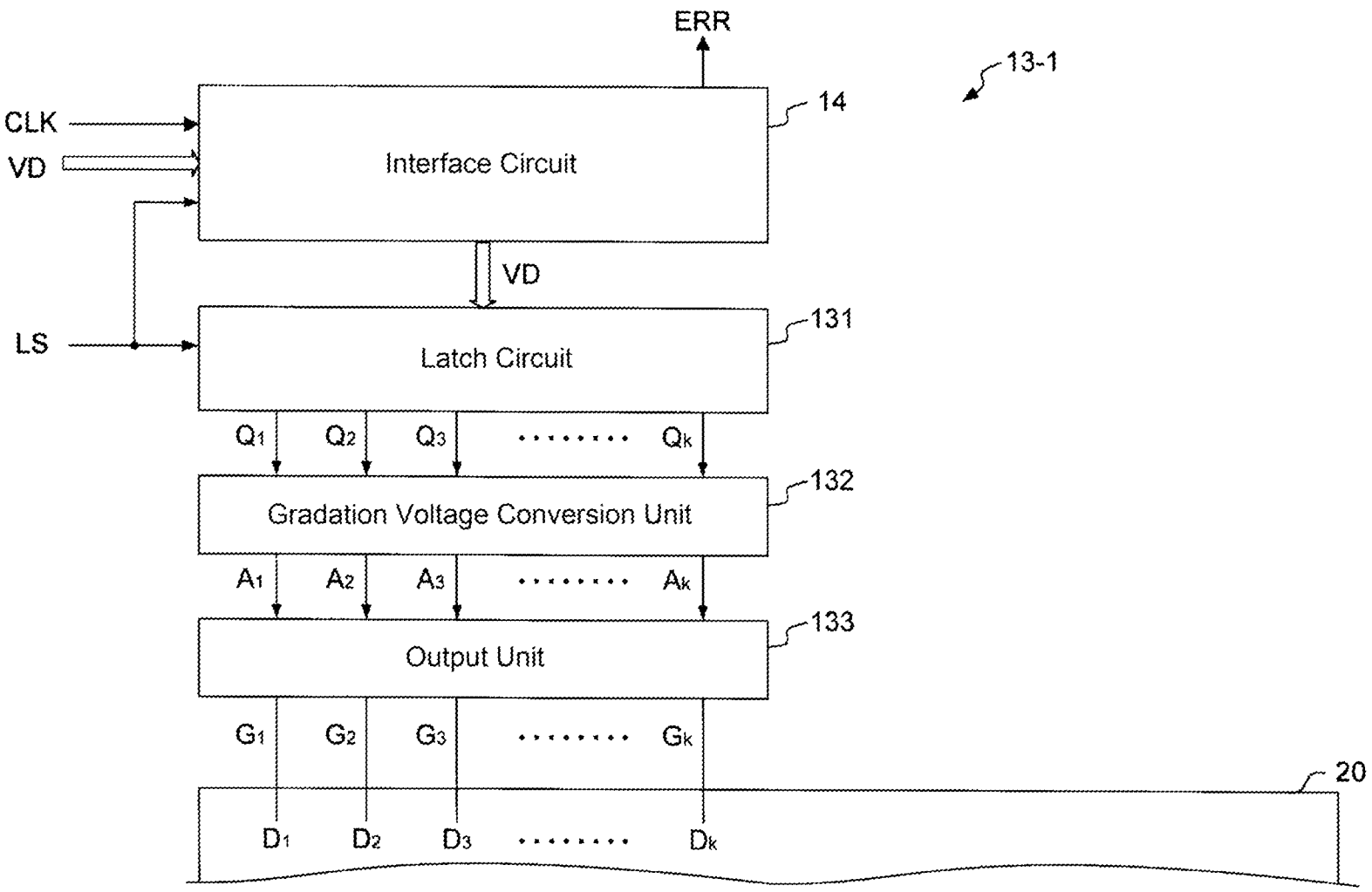
FIG. 2 is a block diagram showing an internal configuration of a source driver 13.

FIG. 2 is a block diagram showing the internal configuration of the source driver 13-1, which is one of the source drivers 13-1 to 13-*p*. The source driver 13-1 includes a latch circuit 131, a gradation voltage conversion unit 132, an output unit 133, and an interface circuit 14. The other source drivers 13-2 to 13-*p* have a similar configuration.

The latch circuit 131 sequentially acquires the sequence of pixel data pieces PD included in the image data signal VD supplied from the display control unit 11 via the interface circuit 14. The latch circuit 131 supplies, to the gradation voltage conversion unit 132, k pixel data pieces PD as pixel data Q1 to Qk every time the pixel data pieces PD corresponding to the output channel count of the source driver 13-1 (that is, a value obtained by dividing pixel data pieces for one horizontal scanning line by the number of source drivers) are acquired in response to the latch start signal LS.

The gradation voltage conversion unit 132 converts the pixel data Q1 to Qk to negative and positive gradation voltages A1 to Ak having voltage values corresponding to the luminance gradations represented by the pixel data Q.

The output unit 133 generates voltages obtained by individually amplifying each of the gradation voltages A1 to Ak at a gain of 1, and supplies the voltages to the source lines D1 to Dk of the display device 20 as pixel drive voltages G1 to Gk.

The interface circuit 14 receives the image data signal VD, the clock signal CLK, and the line start signal LS from the display control unit 11, and supplies the image data signal VD to the latch circuit 131 at a timing indicated by the aforementioned signals. Also, the interface circuit 14 detects anomalies in the source driver 13 and outputs the anomaly detection signal ERR indicating the detection results to the display control unit 11.

Figure 3:
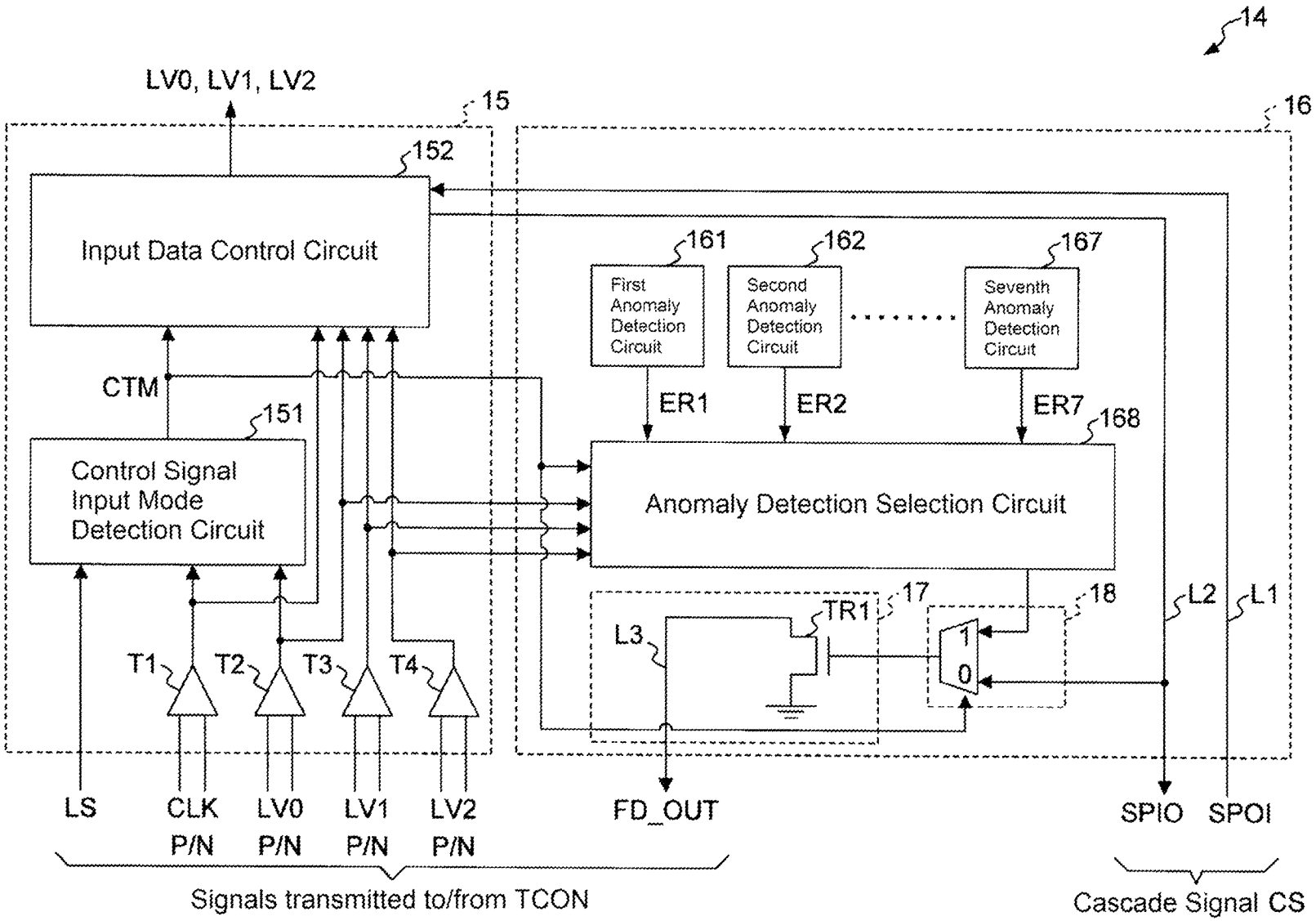
FIG. 3 is a block diagram showing a configuration of an interface circuit 14 of the present embodiment.

FIG. 3 is a block diagram showing a configuration of the interface circuit 14. The interface circuit 14 is constituted of a data control block 15 and an anomaly detection block 16.

The data control block 15 has a control signal input mode detection circuit 151 and an input data control circuit 152. Also, the data control block 15 has input terminals T1, T2, T3, and T4, and receives input of the clock signal CLK and the input data signals LV0 to LV2. The input terminals T1, T2, T3, and T4 are connected to the display control unit 11 via respective data signal lines (not shown).

The clock signal CLK inputted to the input terminal Tl is supplied to the control signal input mode detection circuit 151 and the input data control circuit 152. The input data signal LV0 inputted to the input terminal T2 is supplied to the control signal input mode detection circuit 151, the input data control circuit 152, and an anomaly detection selection circuit 168 of the anomaly detection block 16. The input data signals LV1 and LV2 inputted to the input terminals T3 and T4 are supplied to the input data control circuit 152 and the anomaly detection selection circuit 168.

The control signal input mode detection circuit 151 receives the line start signal LS from the display control unit 11 and receives the clock signal CLK and the input data signal LV0 via the input terminals T1 and T2. The control signal input mode detection circuit 151 detects a period of a data input mode (data input period) during which the input data LV0, LV1, and LV2 is supplied to the latch circuit 131 and period of a control signal input mode (data non-input period) during which a control signal other than the input data signal is inputted without supplying the input data LV0, LV1, and LV2 to the latch circuit 131, on the basis of the line start signal LS, the clock signal CLK, and the input data signal LV0. The control signal input mode detection circuit 151 detects a switch from the control signal input mode to the data input mode when the signal level of the input data signal LV0 is at a logic level of 1 for two clock periods and reaches a logic level of 0 in the subsequent clock period (that is, the logic level undergoes a change of H→H→L over three clock periods), for example.

The control signal input mode detection circuit 151 generates a control mode signal CTM indicating whether the current mode is the control signal input mode according to the signal level, and supplies the control mode signal to the input data control circuit 152 and the anomaly detection selection circuit 168. The control mode signal CTM has the property of a timing signal indicating the timing of switching between the control signal input mode period and the data input mode period according to the change in signal level.

The input data control circuit 152 supplies the input data signals LV0, LV1, and LV2 to the latch circuit 131 during the data input mode period.

Also, the input data control circuit 152 is connected via signal lines L1 and L2 to the input data control circuit provided in the interface circuit of another adjacent source driver in a cascade connection (that is, a source driver in a cascade connection). The input data control circuit 152 has a signal input terminal SPOI connected to the signal line L1 and a signal output terminal SPIO connected to the signal line L2. The input data control circuit 152 receives a start pulse signal SP (first start pulse signal) via the signal line L1 from one adjacent source driver or the display control unit 11. The input data control circuit 152 generates a start pulse signal SP (second start pulse signal) formed by delaying the received start pulse signal SP, and supplies the start pulse signal to another source driver or the display control unit 11. The start pulse signal SP is a signal indicating the start of data input, and is used in order for each source driver to recognize the timing for inputting the mini-LVDS image data when the source drivers are in a cascade connection.

Figure 4:
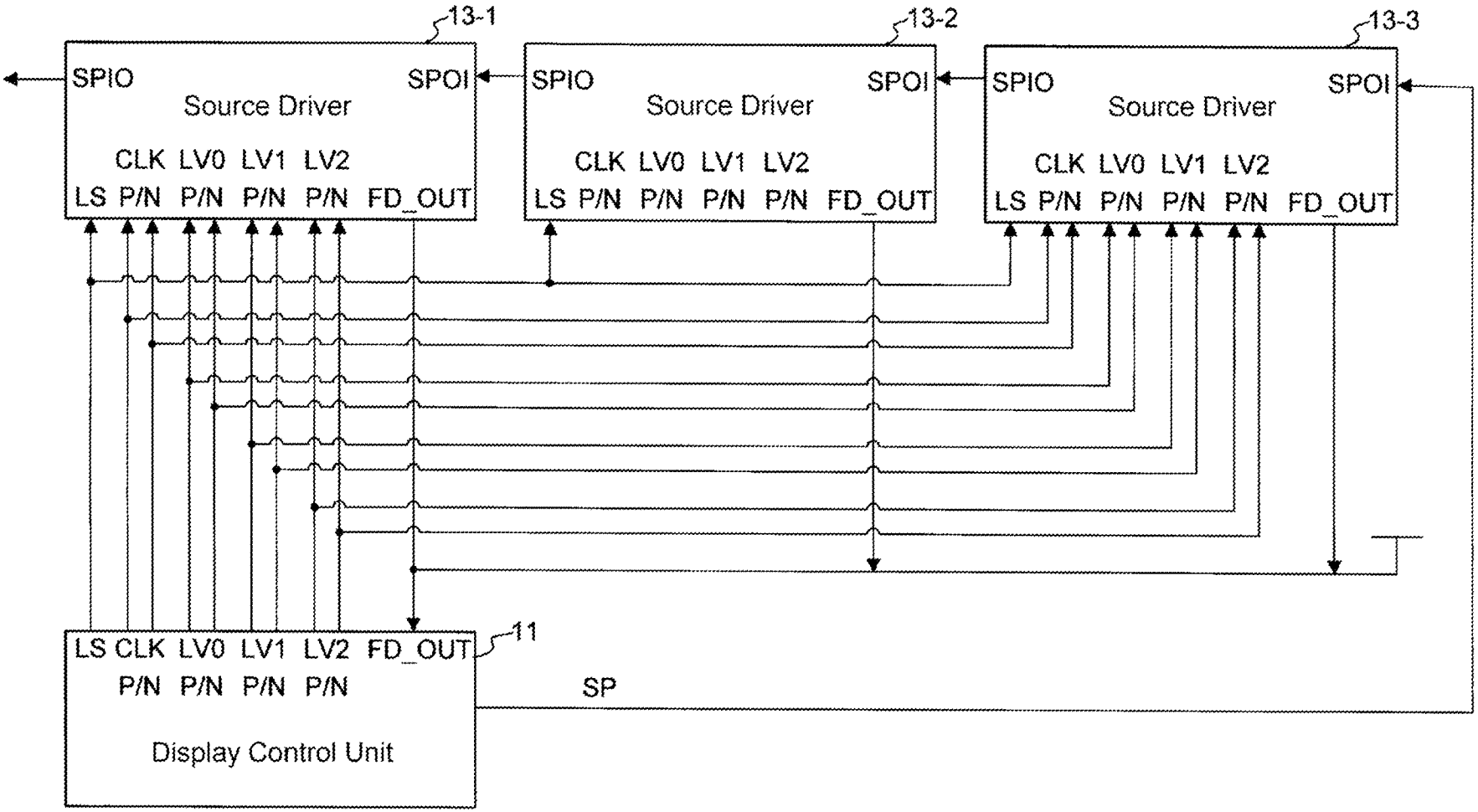
FIG. 4 is a block diagram showing the connective relationship between a plurality of source drivers and a display control unit.

FIG. 4 is a block diagram schematically showing the connective relationship between the plurality of source drivers in a cascade connection and the display control unit 11. Here, a case in which the number of source drivers is three (that is, where p=3 in the block diagram of FIG. 1) is indicated as an example.

The line start signal LS, the clock signal CLK, and the input data signals LV0 to LV2 are respectively supplied from the display control unit 11 to the source drivers 13-1, 13-2, and 13-3. Also, the start pulse signal SP outputted from the display control unit 11 is supplied to the source driver 13-3 and then sequentially supplied to the source driver 13-2 and the source driver 13-1.

Additionally, the source drivers 13-1 to 13-3 have an FD_OUT terminal for outputting the anomaly detection signal ERR and supplying the anomaly detection signal to the display control unit 11.

Returning to FIG. 3, the anomaly detection block 16 has a first anomaly detection circuit 161, a second anomaly detection circuit 162, a third anomaly detection circuit 163, a fourth anomaly detection circuit 164, a fifth anomaly detection circuit 165, a sixth anomaly detection circuit 166, and a seventh anomaly detection circuit 167 (hereinafter referred to collectively as the first to seventh anomaly detection circuits 161 to 167), as well as an anomaly detection selection circuit 168.

The first to seventh anomaly detection circuits 161 to 167 detect an anomalous state such as a temperature anomaly, a voltage anomaly, or a polarity inversion anomaly in the source drivers 13. The first to seventh anomaly detection circuits 161 to 167 each detect different types of anomalies. The first to seventh anomaly detection circuits 161 to 167 supply detection result signals ER1 to ER7 indicating the results of each instance of anomaly detection to the anomaly detection selection circuit 168.

The anomaly detection selection circuit 168 selects one of the first to seventh anomaly detection circuits 161 to 167 at a different clock timing on the basis of the control mode signal CTM and the input data signals LV0, LV1, and LV2 supplied from the data control block 15, and outputs the detection result signal of the selected anomaly detection circuit as the anomaly detection signal ERR.

Also, the anomaly detection block 16 has a signal output unit 17 including a transistor that constitutes an open drain terminal, and a selector 18 that is an additional circuit for detecting defects in the open drain terminal (hereinafter referred to as an open circuit failure).

The signal output unit 17 includes a transistor TR1 that is an N-channel MOS transistor of a first conductivity type, and a signal output line L3 connected to the drain terminal of the transistor TR1.

The source terminal of the transistor TR1 is grounded and is connected to a prescribed potential (that is, ground potential in the present embodiment). The gate terminal of the transistor TR1 is connected to the output unit of the selector 18. The drain terminal of the transistor TR1 is connected to the signal output line L3, which outputs an FD_OUT signal. That is, the drain terminal of the transistor TR1 is an open drain terminal that outputs the FD_OUT signal (also referred to below as the FD_OUT terminal).

The selector 18 receives input of the anomaly detection signal ERR outputted from the anomaly detection selection circuit 168 and the start pulse signal SP outputted from the input data control circuit 152, and selects one of these signals to output. The selector 18 receives the control mode signal CTM from the control signal input mode detection circuit 151 and switches the output signal according to the signal level of the control mode signal CTM. If the signal level of the control mode signal CTM is at the H level, for example, the selector 18 outputs the anomaly detection signal ERR. If the signal level of the control mode signal CTM is at the L level, for example, the selector 18 outputs the start pulse signal SP.

The output signal of the selector 18 is supplied to the gate terminal of the transistor TR1. As a result, if the output signal of the selector 18 is at the H level, then the transistor TR1 turns ON, and a ground potential level (that is, L level) signal is outputted from the FD_OUT terminal.

Figure 5:
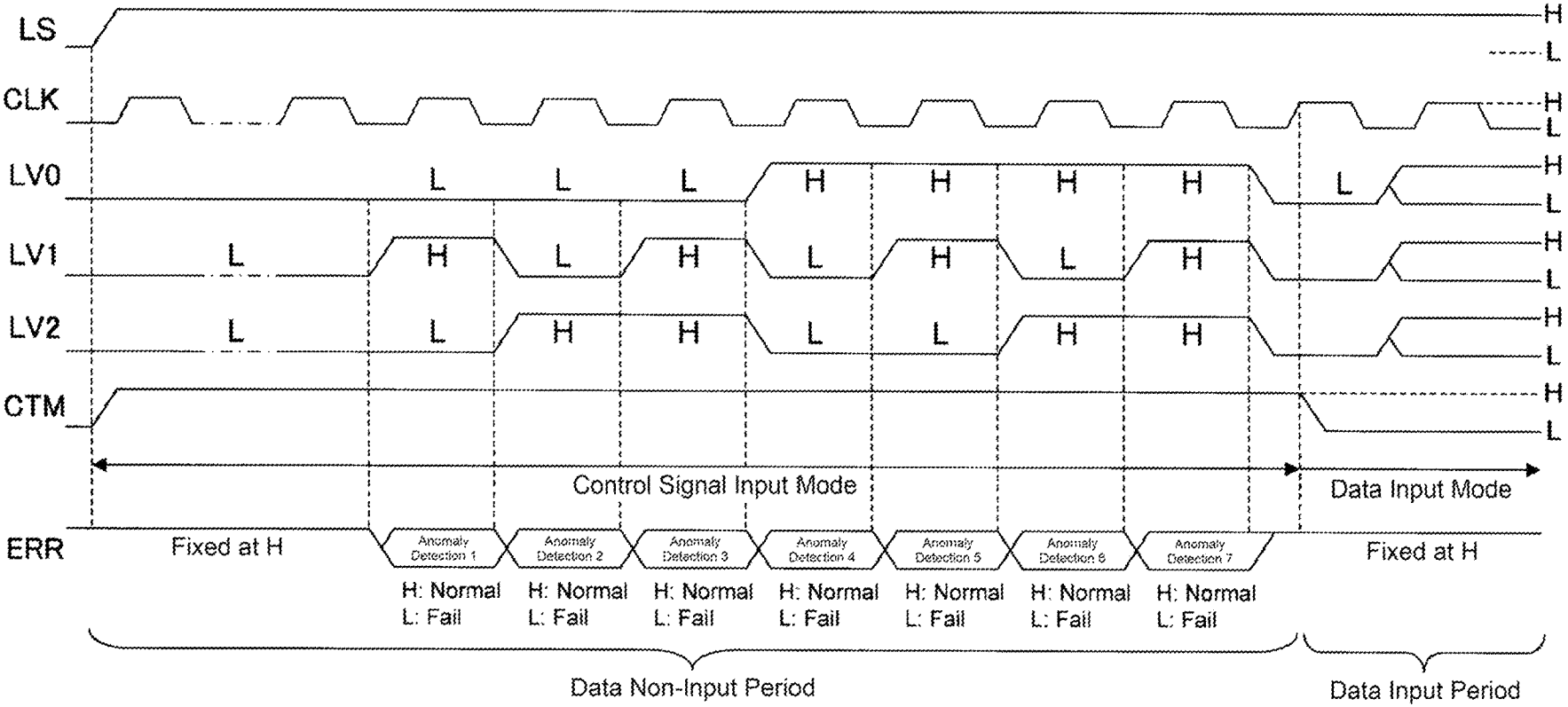
FIG. 5 is a timing chart showing an output operation for anomaly detection results.
Figure 6:
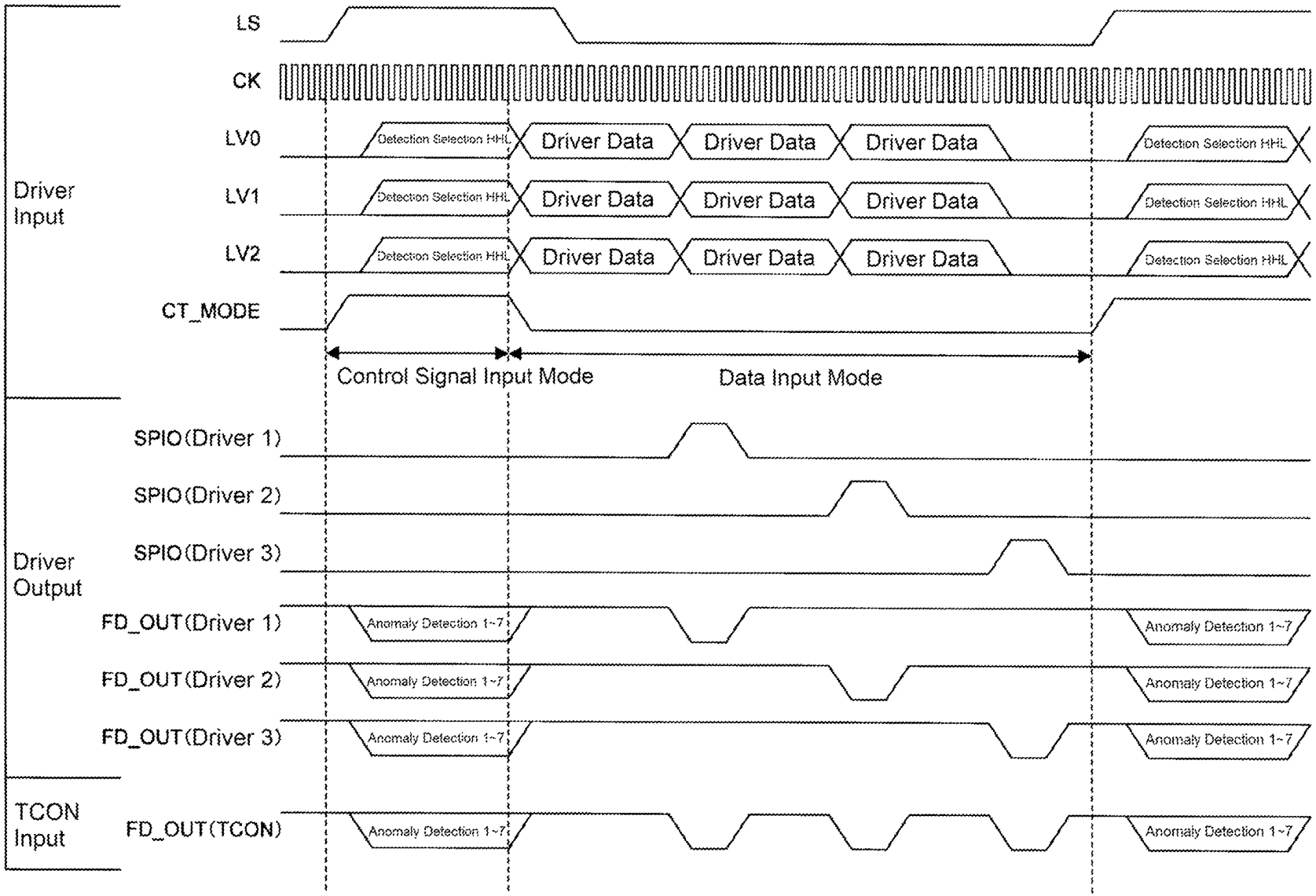
FIG. 6 is a timing chart showing changes in each signal regarding the detection of an open circuit failure.

Next, the operation of the data control block 15 and the anomaly detection block 16 will be described with reference to the timing charts of FIGS. 5 and 6.

First, an anomaly detection operation performed during the control signal input mode period will be described with reference to the timing chart of FIG. 5. The control mode signal CTM is a signal at the H level during the control signal input mode period and at the L level during the data input mode period. Also, the anomaly detection signal ERR is a signal at the H level in a normal state where no anomalies are detected and at the L level when an anomaly has been detected.

The control signal input mode detection circuit 151 generates the control mode signal CTM having a signal level that reaches the H level in synchronization with the rise of the line start signal LS, and supplies the control mode signal to the input data control circuit 152 and the anomaly detection selection circuit 168. The period when the control mode signal CTM is at the H level is the control signal input mode (that is, the data non-input period), and thus, the input data control circuit 152 does not supply the input data signals LV0, LV1, and LV2 to the latch circuit 131. Meanwhile, the anomaly detection selection circuit 168 selects the first to seventh anomaly detection circuits 161 to 167 during this period and outputs the detection results.

If all of the input data signals LV0, LV1, and LV2 are at the L level, the anomaly detection selection circuit 168 does not select any of the first to seventh anomaly detection circuits 161 to 167 and outputs the anomaly detection signal ERR at the H level.

If the input data signals LV0 and LV2 are at the L level and the input data signal LV1 is at the H level, the anomaly detection selection circuit 168 selects the first anomaly detection circuit 161. The anomaly detection selection circuit 168 outputs the anomaly detection signal ERR having the L level if an anomaly was detected and the H level if no anomaly was detected according to the detection result signal ER1 supplied from the first anomaly detection circuit 161.

If the input data signals LV0 and LV1 are at the L level and the input data signal LV2 is at the H level, the anomaly detection selection circuit 168 selects the second anomaly detection circuit 162. The anomaly detection selection circuit 168 outputs the anomaly detection signal ERR having the L level if an anomaly was detected and the H level if no anomaly was detected according to the detection result signal ER2 supplied from the second anomaly detection circuit 162.

If the input data signal LV0 is at the L level and the input data signals LV1 and LV2 are at the H level, the anomaly detection selection circuit 168 selects the third anomaly detection circuit 163. The anomaly detection selection circuit 168 outputs the anomaly detection signal ERR having the L level if an anomaly was detected and the H level if no anomaly was detected according to the detection result signal ER3 supplied from the third anomaly detection circuit 163.

If the input data signal LV0 is at the H level and the input data signals LV1 and LV2 are at the L level, the anomaly detection selection circuit 168 selects the fourth anomaly detection circuit 164. The anomaly detection selection circuit 168 outputs the anomaly detection signal ERR having the L level if an anomaly was detected and the H level if no anomaly was detected according to the detection result signal ER4 supplied from the fourth anomaly detection circuit 164.

If the input data signals LV0 and LV1 are at the H level and the input data signal LV2 is at the L level, the anomaly detection selection circuit 168 selects the fifth anomaly detection circuit 165. The anomaly detection selection circuit 168 outputs the anomaly detection signal ERR having the L level if an anomaly was detected and the H level if no anomaly was detected according to the detection result signal ER5 supplied from the fifth anomaly detection circuit 165.

If the input data signals LV0 and LV2 are at the H level and the input data signal LV1 is at the L level, the anomaly detection selection circuit 168 selects the sixth anomaly detection circuit 166. The anomaly detection selection circuit 168 outputs the anomaly detection signal ERR having the L level if an anomaly was detected and the H level if no anomaly was detected according to the detection result signal ER6 supplied from the sixth anomaly detection circuit 166.

If all of the input data signals LV0, LV1, and LV2 are at the H level, the anomaly detection selection circuit 168 selects the seventh anomaly detection circuit 167. The anomaly detection selection circuit 168 outputs the anomaly detection signal ERR having the L level if an anomaly was detected and the H level if no anomaly was detected according to the detection result signal ER7 supplied from the seventh anomaly detection circuit 167.

The selector 18 outputs the anomaly detection signal ERR in response to the supply of the H level control mode signal. As a result, the transistor TR1 is controlled so as to be ON or OFF according to the signal level of the anomaly detection signal ERR, and the FD_OUT signal having a signal level at the L level if an anomaly was detected and at the H level if no anomaly was detected is outputted from the FD_OUT terminal Then, when the input data signal LV0 reaches the L level, the signal level over three clock periods of the input data signal LV0 changes according to H→H→L, and thus, the control signal input mode detection circuit 151 detects a transition from the control signal input mode to the data input mode, and changes the signal level of the control mode signal CTM to the L level.

Upon receiving the L level control mode signal CTM, the anomaly detection selection circuit 168 stops selection of the anomaly detection circuits. The anomaly detection selection circuit 168 outputs the anomaly detection signal ERR fixed at the H level.

The input data control circuit 152, in response to the control mode signal CTM changing to the L level, starts supply of the input data signals LV0, LV1, and LV2 to the latch circuit 131.

Next, the operation of the open circuit anomaly detection process performed during the data input mode period will be described with reference to the timing chart of FIG. 6.

When the control mode signal CTM reaches the L level and it is detected, with the rise of the clock signal CLK, that the level of the input data signal LV0 has changed according to H→H→L, the input data control circuit 152 of the source driver 13-1 (driver 1 of FIG. 6) outputs the start pulse signal SP. The start pulse signal SP is a one-pulse signal that reaches the H level for a prescribed period. The start pulse signal SP is outputted to another adjacent source driver from the signal output terminal SPIO and supplied to the selector 18.

Upon receiving the L level control mode signal CTM, the selector 18 switches the output signal and outputs the start pulse signal SP.

The gate terminal of the transistor TR1 has applied thereto the start pulse signal SP and turns ON during the period in which the start pulse signal SP is at the H level. As a result, an L level FD_OUT signal is outputted from the drain terminal of the transistor TR1.

Similar processes are sequentially performed for the source drivers 13-1, 13-2, and 13-3. That is, as shown in FIG. 6, FD_OUT signals that reach the L level for a prescribed period with the opposite logical value to the start pulse signal SP are sequentially outputted to the respective source drivers and supplied to the display control unit 11.

Figure 7:
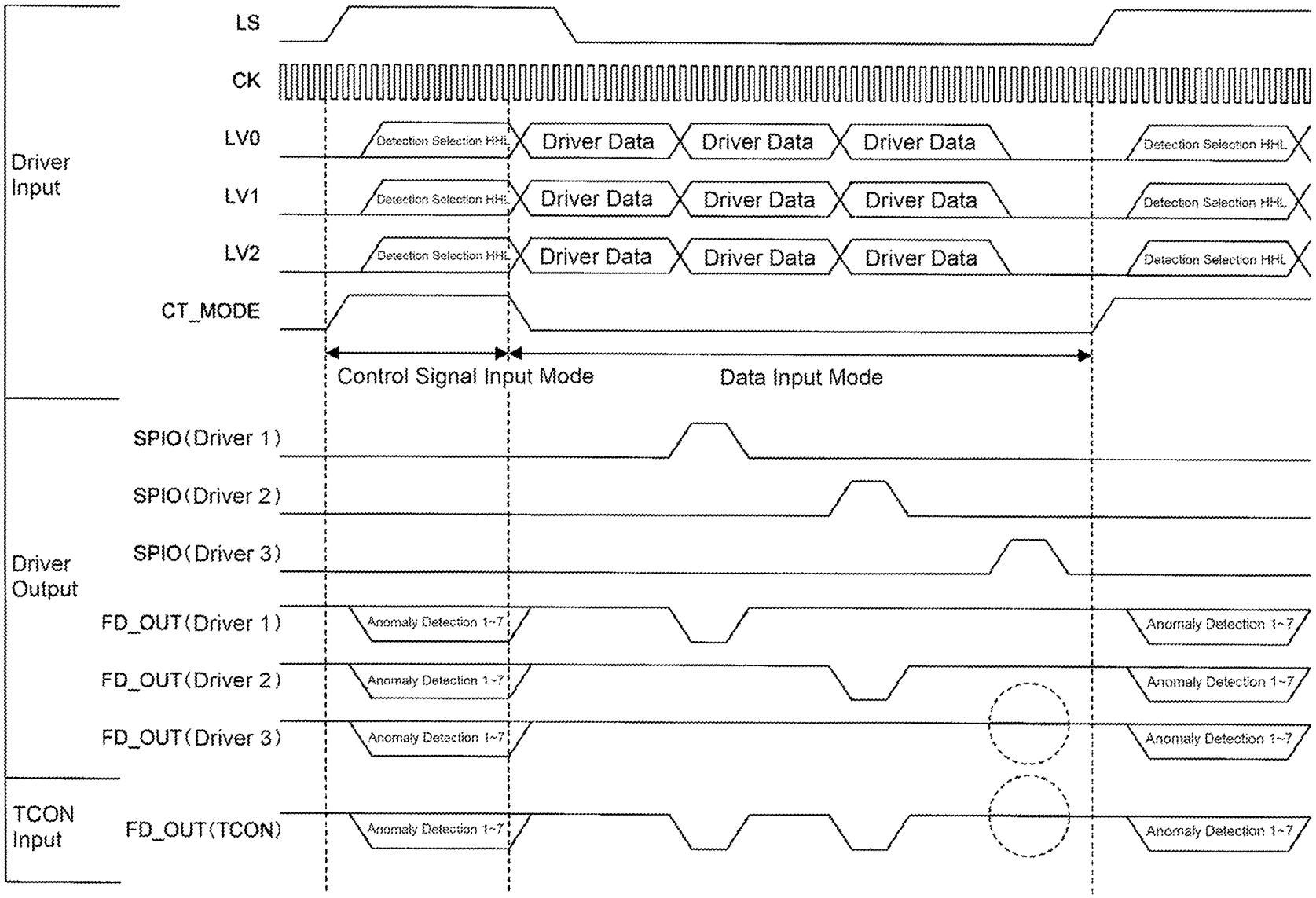
FIG. 7 is a timing chart showing signal changes for when an open circuit failure has occurred.

FIG. 7 is a timing chart showing the signal level of the FD_OUT signal for when an open circuit failure has occurred in the source driver 13-3 (driver 3). If an open circuit failure has occurred in the source driver 13-3, an H level FD_OUT signal is outputted during a period when an L level FD_OUT signal should typically be outputted by the source driver 13-3 (section in the drawing indicated with the broken line circle).

The display control unit 11 receives the FD_OUT signals from the source drivers 13-1 to 13-3 and compares the number of instances of the FD_OUT signal reaching the L level to the number of source drivers (three in the present embodiment, for example), thereby determining if any of the source drivers 13-1 to 13-3 has an open circuit failure.

Figure 8:
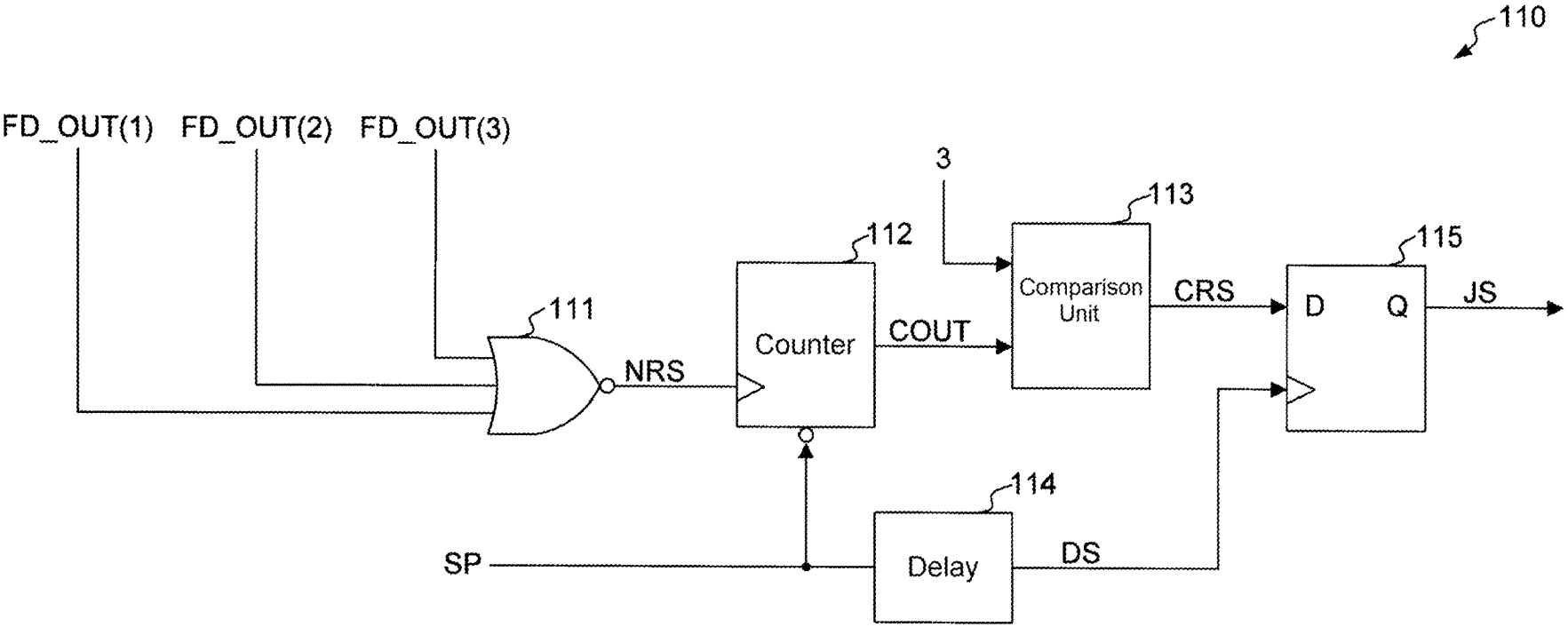
FIG. 8 is a block diagram showing a configuration of an open circuit failure detection circuit provided in a display control unit.

FIG. 8 is a block diagram showing a configuration example of a failure detection circuit 110 provided in the display control unit 11. The failure detection circuit 110 is constituted of an NOR gate 111, a counter 112, a comparison unit 113, a delay circuit 114, and a D flip-flop 115.

The NOR gate 111 receives input of an FD_OUT signal outputted from the source driver 13-1 (hereinafter referred to as a first FD_OUT signal (1)), an FD_OUT signal outputted from the source driver 13-2 (hereinafter referred to as a second FD_OUT signal (2)), and an FD_OUT signal outputted from the source driver 13-3 (hereinafter referred to as a third FD_OUT signal (3)) and outputs a NOR signal NRS that is the logical NOR of the aforementioned FD_OUT signals. If at least one of the first FD_OUT signal (1), the second FD_OUT signal (2), and the third FD_OUT signal (3) reaches the L level, an L level NOR signal NRS is outputted.

The counter 112 counts the number of L level NOR signals NRS. The counter 112 performs a count-up in response to the supply of L level NOR signals NRS and outputs a count value COUT. The start pulse signal SP is supplied to the reset terminal of the counter 112, and the count value COUT is reset in response to the rise of the start pulse signal SP.

The comparison unit 113 compares the count value COUT to the number of source drivers (three in the present embodiment), and outputs a comparison result signal CRS indicating "1" if the values match and "0" if the values do not match. Information regarding the number of source drivers is stored in a memory (not shown) in the display control unit 11, for example, and information read from the memory is supplied to the comparison unit 113.

The delay circuit 114 generates a delay signal DS formed by delaying the start pulse signal SP for a prescribed period, and supplies the delay signal to the clock terminal of the D flip-flop 115.

The D flip-flop 115 reads in the signal value of the comparison result signal CRS outputted from the comparison unit 113 in synchronization with the delay signal DS, and upon retaining the signal value for a prescribed period outputs the signal value as a failure determination signal JS.

Through the signal level of the failure determination signal JS, it is determined whether all of the open drain terminals of the source drivers 13-1 to 13-3 are in normal operation, or if at least one open drain terminal has undergone an open circuit failure. If the number of L level FD_OUT signals matches the number of source drivers, for example, then an H level failure determination signal JS indicating that an open circuit failure has not occurred in any of the source drivers (that is, the source drivers are in normal operation) is outputted. On the other hand, if the number of L level FD_OUT signals does not match the number of source drivers, then an L level failure determination signal JS indicating that an open circuit failure has occurred in one of the source drivers (that is, an anomaly has occurred) is outputted.

As described above, in the interface circuit 14 of the present embodiment, if there is no failure in the open drain terminals, then an L level FD_OUT signal is outputted according to the timing of the supply of the start pulse signal SP, and supplied to the display control unit 11. The display control unit 11 receives the FD_OUT signals from the source drivers 13-1 to 13-3 and compares the number of instances of the FD_OUT signal reaching the L level to the number of source drivers, thereby determining if any of the source drivers 13-1 to 13-3 has an open circuit failure (that is, detecting if an open circuit failure has occurred in any of the source drivers, or if an open circuit failure has not occurred in any of the source drivers).

Thus, according to the interface circuit 14 according to the present embodiment, it is possible to detect whether an open circuit failure has occurred in any of the signal output terminals of a plurality of source drivers in a cascade connection.

Figure 9:
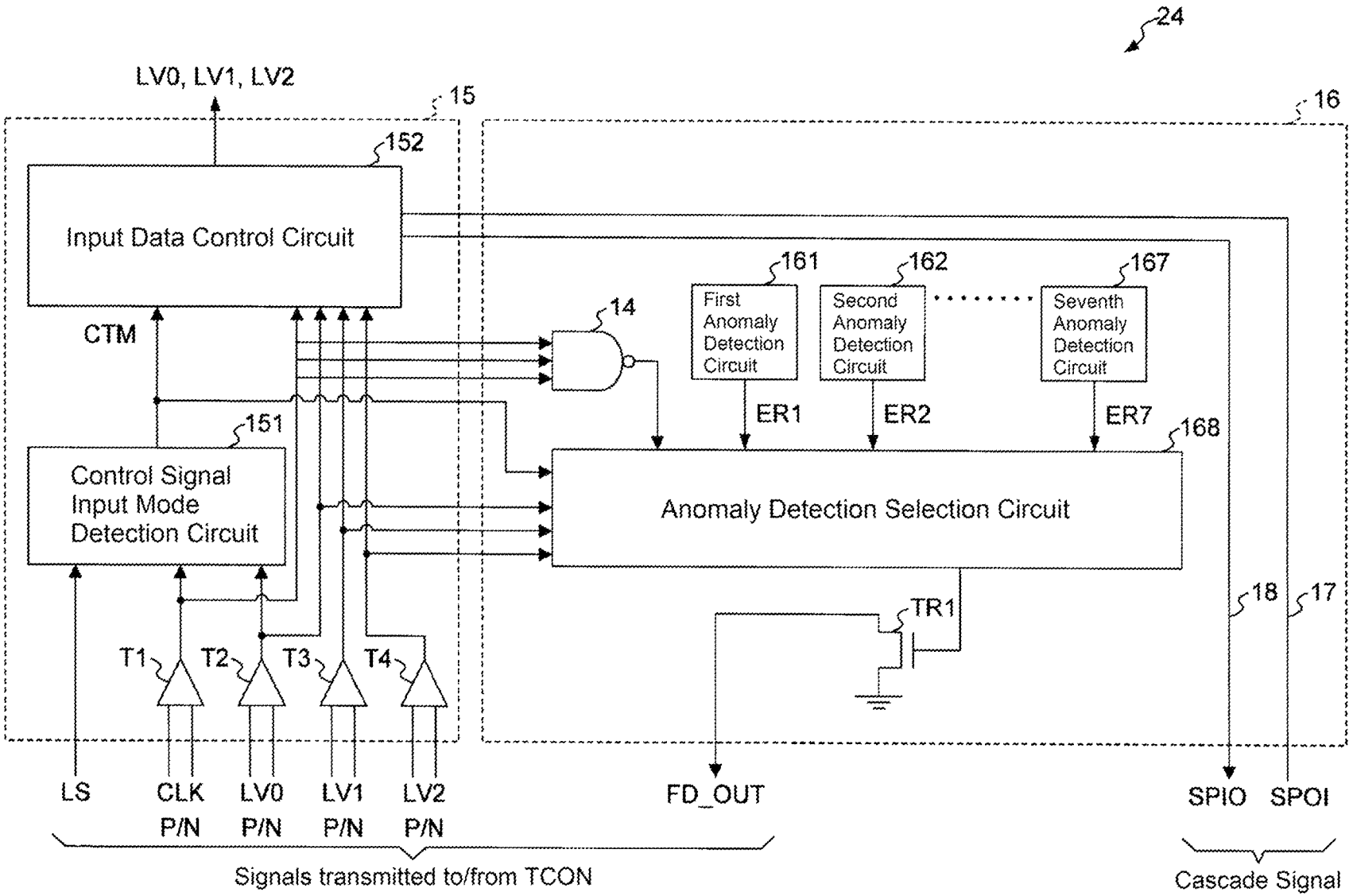
FIG. 9 is a block diagram showing a configuration of an interface circuit of a comparison example.

FIG. 9 is a block diagram showing a configuration of an interface circuit 24 of a comparison example that, unlike the interface circuit 14 of the present embodiment, does not have a configuration corresponding to the selector 18. Unlike the interface circuit 14 of the present embodiment, in the interface circuit 24 of the comparison example, a voltage based on the output of the anomaly detection selection circuit 168 is applied to the gate terminal of the transistor TR1 regardless of the supply timing of the start pulse signal SP.

In the interface circuit 24 of the comparison example, by providing a configuration such that when all signal levels of the input data signals LV0, LV1, and LV2 are at an H level, an L level FD_OUT signal is outputted, it is possible to detect an open circuit failure in an FD_OUT terminal However, if a plurality of source drivers are in a cascade connection, then even if a disconnection were to occur in the FD_OUT terminal of one source driver (e.g., the source driver 13-3 in FIG. 4), an L level FD_OUT signal is outputted from the other source drivers (e.g., the source drivers 13-1 and 13-2 of FIG. 4), and thus, the display control unit 11 determines that an open circuit failure has not occurred in any of the source drivers.

By contrast, according to the interface circuit 14 of the present embodiment, each of the plurality of source drivers outputs the FD_OUT signal at differing timings, and thus, the display control unit 11 counts the number of L level FD_OUT signals and compares this number to the number of source drivers, thereby enabling determination as to whether an open circuit failure has occurred in any of the source drivers 13-1 to 13-3.

The present invention is not limited to the embodiment above. In the embodiment above, for example, a case was described in which the number of source drivers is three, but the number of source drivers is not limited thereto.

Also, the combination of signal levels (H and L) of each signal can be modified as appropriate. For example, in the present embodiment, a configuration was described in which when an L level FD_OUT signal is outputted no open circuit failure has occurred, but a configuration may be adopted in which the signal level is inverted and an H level FD_OUT signal is outputted instead.

What is claimed is:

1. An interface circuit that is provided to one source driver that is configured to drive a display device, the interface circuit being configured to receive input of a plurality of data signals, each of which is constituted of a sequence of pixel data pieces, and supply the plurality of data signals to a data latch circuit provided to the one source driver, the interface circuit comprising:

a timing signal generating circuit that is configured to receive input of a clock signal and, on the basis of at least one of the plurality of data signals and the clock signal, generate a timing signal indicating a timing for switching between a data input period during which the plurality of data signals are supplied to the data latch circuit, and a non-input period during which supply of the plurality of data signals is stopped;

a data control circuit that is configured to receive input of a first start pulse signal indicating a start of data input of the plurality of data signals to the data latch circuit, control supply of the plurality of data signals to the data latch circuit on the basis of the timing signal and the first start pulse signal, and output, to another source driver connected to the one source driver, a second start pulse signal that is a signal formed by delaying the first start pulse signal;

a plurality of anomaly detection circuits that are configured to detect an anomaly that has occurred in the one source driver;

a detection result selection circuit that is configured to select one of the plurality of anomaly detection circuits on the basis of the plurality of data signals, and output a detection result signal indicating a detection result of the selected anomaly detection circuit at a timing based on the timing signal and the clock signal, during the non-input period;

a selector that is configured to receive input of the second start pulse signal and the detection result signal, and, on the basis of the timing signal, selectively output either one of the second start pulse signal or the detection result signal; and a signal output unit that includes a first conductivity type MOS transistor having a gate terminal that is connected to an output unit of the selector and a source terminal that is connected to a prescribed potential, and a signal output line that is connected to a drain terminal of the MOS transistor.

2. The interface circuit according to claim 1, wherein the selector outputs the detection result signal if a signal level of the timing signal is a signal level corresponding to the non-input period, and outputs the second start pulse signal if the signal level of the timing signal is a signal level corresponding to the data input period.

3. A source driver that is configured to drive a display device on the basis of a plurality of data signals, each of which is constituted of a sequence of pixel data pieces, the source driver comprising:

an interface circuit that is configured to receive a clock signal and the plurality of data signals, and output the plurality of data signals according to a clock timing of the clock signal;

a latch circuit that is configured to acquire the plurality of data signals outputted from the interface circuit and output the data signals as each of the plurality of pixel data pieces corresponding to a pixel column in a scanning line direction of the display device;

a gradation voltage generating unit that is configured to generate a plurality of gradation voltages on the basis of the plurality of pixel data pieces outputted from the latch circuit; and an output unit that is configured to select one gradation voltage corresponding to a luminance level indicated by the pixel data pieces from among the plurality of gradation voltages, and output a signal having the one gradation voltage as a driving signal of the display device, and wherein the interface circuit includes:

a timing signal generating circuit that is configured to receive input of the clock signal and, on the basis of at least one of the plurality of data signals and the clock signal, generate a timing signal indicating a timing for switching between a data input period during which the plurality of data signals are supplied to the latch circuit, and a non-input period during which supply of the plurality of data signals is stopped;

a data control circuit that is configured to receive input of a first start pulse signal indicating a start of data input of the plurality of data signals to the latch circuit, control supply of the plurality of data signals to the latch circuit on the basis of the timing signal and the first start pulse signal, and output, to another source driver connected to the source driver, a second start pulse signal that is a signal formed by delaying the first start pulse signal;

a plurality of anomaly detection circuits that are configured to detect an anomaly that has occurred in the source driver;

a detection result selection circuit that is configured to select one of the plurality of anomaly detection circuits on the basis of the plurality of data signals, and output a detection result signal indicating a detection result of the selected anomaly detection circuit at a timing based on the timing signal and the clock signal, during the non-input period;

a selector that is configured to receive input of the second start pulse signal and the detection result signal, and, on the basis of the timing signal, selectively output either one of the second start pulse signal or the detection result signal; and a signal output unit that includes a first conductivity type MOS transistor having a gate terminal that is connected to an output unit of the selector and a source terminal that is connected to a prescribed potential, and a signal output line that is connected to a drain terminal of the MOS transistor.

4. A display device, comprising:

a display panel having a plurality of data lines and a plurality of scanning lines, and pixel switches and pixel units provided at respective intersections between the plurality of data lines and the plurality of scanning lines;

a display control unit that is configured to output a clock signal, a plurality of data signals, each of which is constituted of a sequence of pixel data pieces, and a start pulse signal indicating a start for acquiring the pixel data pieces; and a plurality of source drivers that are disposed along an extension direction of the scanning lines, and each of which is configured to drive the display device on the basis of the plurality of data signals, wherein each of the plurality of source drivers includes:

an interface circuit that is configured to receive a clock signal and the plurality of data signals, and output the plurality of data signals according to a clock timing of the clock signal;

a latch circuit that is configured to acquire the plurality of data signals outputted from the interface circuit and output the data signals as each of the plurality of pixel data pieces corresponding to a pixel column in a scanning line direction of the display device;

a gradation voltage generating unit that is configured to generate a plurality of gradation voltages on the basis of the plurality of pixel data pieces outputted from the latch circuit; and an output unit that is configured to select one gradation voltage corresponding to a luminance level indicated by the pixel data pieces from among the plurality of gradation voltages, and output a signal having the one gradation voltage as a driving signal of the display device, and wherein the interface circuit includes:

a timing signal generating circuit that is configured to receive input of the clock signal and, on the basis of at least one of the plurality of data signals and the clock signal, generate a timing signal indicating a timing for switching between a data input period during which the plurality of data signals are supplied to the latch circuit, and a non-input period during which supply of the plurality of data signals is stopped;

a data control circuit that is configured to receive input of a first start pulse signal indicating a start of data input of the plurality of data signals to the latch circuit, control supply of the plurality of data signals to the latch circuit on the basis of the timing signal and the first start pulse signal, and output, to another source driver connected to the source driver, a signal formed by delaying the start pulse signal;

a plurality of anomaly detection circuits that are configured to detect an anomaly that has occurred in the source driver;

a detection result selection circuit that is configured to select one of the plurality of anomaly detection circuits on the basis of the plurality of data signals, and output a detection result signal indicating a detection result of the selected anomaly detection circuit at a timing based on the timing signal and the clock signal, during the non-input period;

a selector that is configured to receive input of the start pulse signal and the detection result signal, and, on the basis of the timing signal, selectively output either one of the start pulse signal or the detection result signal; and a signal output unit that includes a first conductivity type MOS transistor having a gate terminal that is connected to an output unit of the selector and a source terminal that is connected to a prescribed potential, and a signal output line that is connected to a drain terminal of the MOS transistor.

5. The display device according to claim 4, wherein the display control unit, on the basis of a signal level of the output signal outputted from the signal output unit of each of the plurality of source drivers, compares a number of instances that the signal level of the output signal has reached a prescribed level to a count of the plurality of source drivers, and determines on the basis of comparison results thereof whether a failure has occurred in the signal output unit of any of the plurality of source drivers.

* * * * *